United States Patent [19]

Grillo

[11] 4,045,933

[45] Sept. 6, 1977

[54] PREFABRICATED PANEL STRUCTURE

[76] Inventor: Joseph R. Grillo, 1815 E. 21st St., Brooklyn, N.Y. 11229

[21] Appl. No.: 700,723

[22] Filed: June 28, 1976

[51] Int. Cl.[2] ..... E04C 2/38; E04B 2/28

[52] U.S. Cl. ..... 52/475; 52/483; 52/513; 52/620

[58] Field of Search ..... 52/601, 580, 620–623, 52/511, 513, 474, 477, 483, 619, 506

[56] References Cited

U.S. PATENT DOCUMENTS

| | | | |
|---|---|---|---|
| 1,983,020 | 12/1934 | De Vol | 52/601 |
| 3,350,830 | 11/1967 | Smith et al. | 52/513 |

FOREIGN PATENT DOCUMENTS

| | | | |
|---|---|---|---|
| 576,628 | 5/1959 | Canada | 52/309 |
| 1,404,338 | 5/1965 | France | 52/620 |

*Primary Examiner*—James L. Ridgill, Jr.
*Attorney, Agent, or Firm*—Burgess, Ryan and Wayne

[57] ABSTRACT

A prefabricated panel utilizing a lightweight metal frame fabricated from metal members having a web and two substantially parallel flanges which extend in opposite directions from the edges of the web. The facing is joined to said frame by means of joining means which extend from the back of said facing through holes in the flanges of the members of the frame.

3 Claims, 5 Drawing Figures

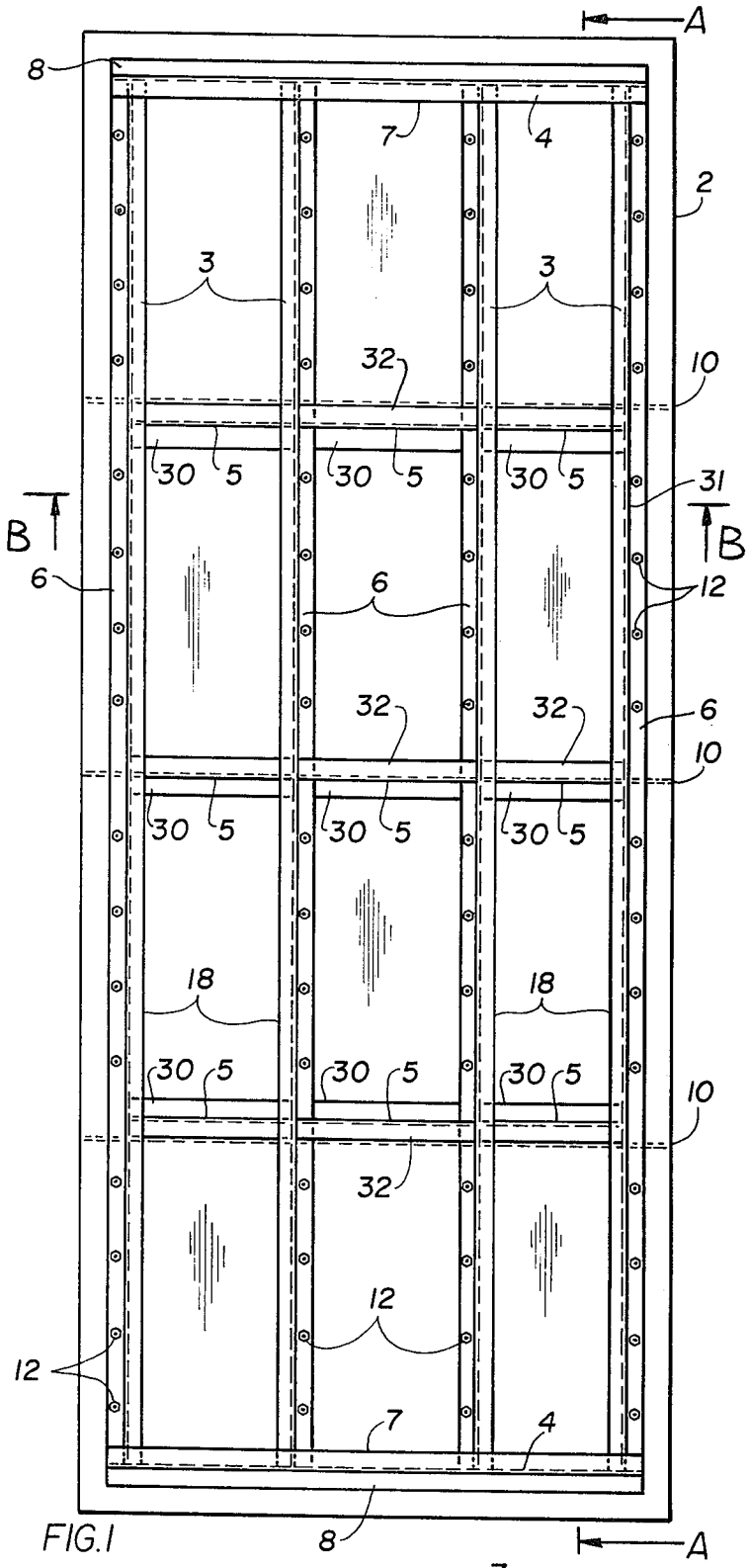
FIG.1
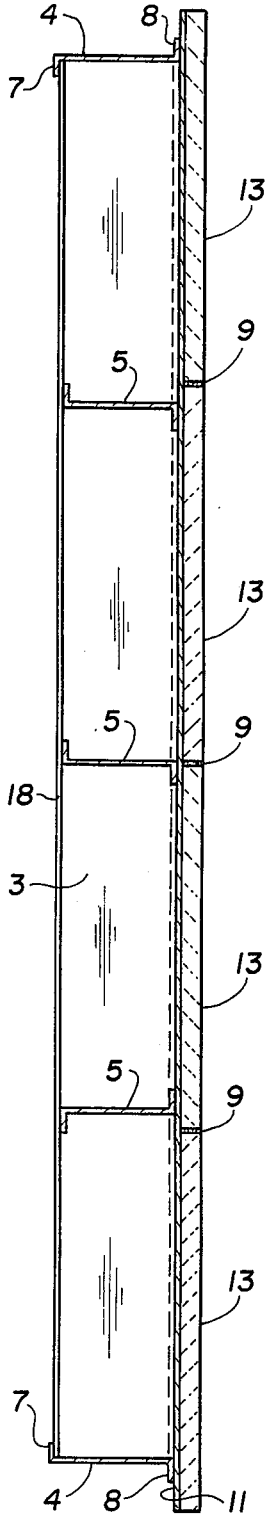
FIG.2
(A-A)
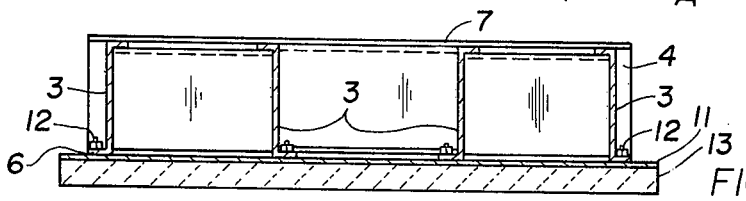
FIG.3 (B-B)

PREFABRICATED PANEL STRUCTURE

BACKGROUND OF THE INVENTION

The invention relates to a lightweight frame for supporting a facing material in a prefabricated panel. Particularly, the invention relates to a prefabricated panel useful for building walls. Most particularly, the invention relates to prefabricated panels having stone facing.

Due to its physical and esthetic qualities, stone has long been one of the most preferred materials for the exterior facing of buildings.

Traditional techniques for utilizing stone as an exterior facing required walls of stone which would be self supporting vertically as well as stable horizontally over the height of the structure.

Modern construction techniques have been directed to reducing the amount and cost of the stone required to erect a structure and to reduce the weight of the structure so that smaller foundations are required.

One solution to reduce the amount of stone requird to erect a structure involves building a backup wall of cinder blocks or reinforced concrete to which a relatively thin facing of the more expensive natural stone is attached. The double wall construction remains relatively heavy however and requires a double operation since the backup wall has to be built before the stone facing can be applied. The double wall system has proven to be both time consuming and expensive, particularly in multi-store structures which require elaborate scaffolding for the full height of the structure.

With the advent of mechanized apparatus such as cranes and motorized lifting apparatus, it became advantageous to "prefabricate" large sections of the exterior wall under controlled conditions in a factory, transport the sections to the building site and fasten them to the building framework. The prefabricated sections were normally reinforced concrete to which the stone facing was laminated during the casting operation. The prefabricated sections were excessively heavy, required large foundations and presented formidable engineering problems in attaching them to the building structure.

In view of the disadvantages of prefabricated sections in which a stone facing is laminated to a reinforced concrete panel, attempts have been made to develop a prefabricated exterior wall panel system in which stone facing is supported on a metal framework. The attempts have not been commercially successful due to complex fabrication techniques and the use of mechanical connectors at the edges of the stone facing.

The steel framework utilized in the prefabricated panels was usually fabricated of metal "channel studs" similar to those used to replace wooden studs in erecting interior partitions. Channel studs do not readily adapt themselves to easy cutting and fitting nor do they facilitate connection between the frame and the stone. In addition, the edge connectors utilized to join the stone to the frame caused considerable breakage during movement of the prefabricated panels.

It is an object of the present invention to provide a lightweight rigid metal frame to support stone facing in a prefabricated panel. It is another object of the invention to provide a metal frame which lends itself to easy attaching of the stone to the frame. It is a further object of the invention to provide a means of fastening the stone firmly to the frame without imposing excessive local stresses. It is another object of the invention to provide a system which can accomodate stones of a relatively large surface area while maintaining their surfaces substantially in a single plane.

Another object of the invention is to provide a frame which can be readily manufactured in a variety of lengths and widths. A further object of the invention is to provide a frame which can be manufactured in a variety of lengths and widths, with a minimum of custom cutting, fitting and fastening, using assembly line techniques.

In addition, it is an object of the invention to provide a prefabricated panel which is easy to lift, handle and transport. A further object of the invention is to provide a prefabricated panel which can be simply and dependably fastened to the building structure.

BRIEF SUMMARY OF THE INVENTION

The objects of the invention are achieved by a frame which comprises substantially parallel longitudinal members, fixed at the ends by transverse end members and stiffened with cross braces attached to the longitudinal members.

The longitudinal members, transverse end members and optionally the cross braces are metal members having a web with two substantially parallel flanges extending in opposite directions from the edges of the web. The metal members in cross section roughly resemble a Z with the angle between the web and the flange at about 90°. It is preferable that the cross braces have the Z configuration but other configurations can be utilized.

The longitudinal members and transverse end members are arranged so that at least the flanges on one side of the members are in substantial planar alignment.

The side of the frame having the flanges of the longitudinal and transverse end members in substantial planar alignment is the side of the frame which is nearest to the facing. The flanges on at least the longitudinal members which are in substantial alignment with the flanges of the transverse end members have holes for engaging joining means attached to the stone facing.

In assembling the prefabricated panel, a frame is constructed. A substantially flat rigid member is optionally affixed to the frame as by gluing or fastening to the frame, e.g., by screws, rivets or other suitable means. The side of the frame having the flanges of the longitudinal and transverse end members in substantially planar alignment is the side placed in contact with the flat rigid member. The metal frame with the flat rigid member affixed thereto is placed on top of the stones. The stones are laid out on a flat surface in a required configuration with their back faces in substantially planar alignment. Holes are drilled through the flat rigid member and into the stone facing through the holes in the webs, the webs already have had holes punched or drilled therethrough in appropriate and/or suitable locations. The hole in the stone facing is not drilled through but is left as a blind hole. A means adapted for joining the stone facing to the frame is then fastened into the blind hole through the hole in the frame and the joining is completely by manipulation of the joining means.

DESCRIPTION OF THE DRAWINGS

FIG. 1 is a view from the back of an assembled panel;

FIG. 2 is a section of a panel taken along A—A;

FIG. 3 is a section of a panel taken along B—B;

The same numbers are used to denote the corresponding parts in each figure.

DETAILED DESCRIPTION OF THE INVENTION

Figure 4:
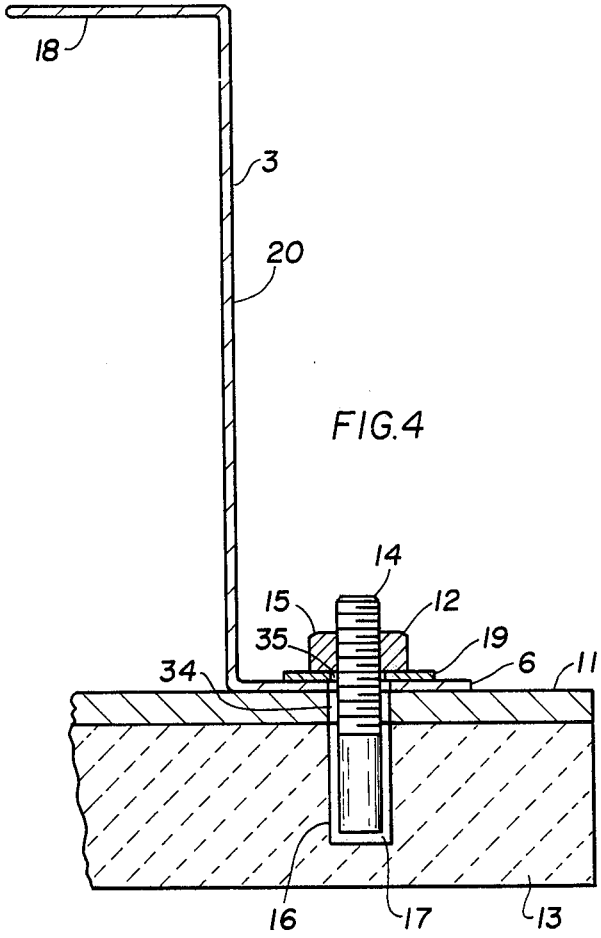
FIG. 4 is a detail of a section of the panel taken through the means for joining the facing to the frame and showing the cross section of a longitudinal member.

The essential concept of the invention is the use of the Z shaped members in forming the frame which supports the stone, the use of joining means anchored in blind holes drilled from the back of the stone and a flat rigid member to provide a smooth flat surface to support the stone and to add rigidity to the frame.

Referring to the drawings and particularly to FIG. 1, which illustrates an assembled panel 2 from the rear, a substantially flat rigid member 11 is coextensive with the stone which is to be supported by the frame. The stone is in several sections as shown by dotted lines 10.

Substantially parallel longitudinal members 3 are fixed at the ends by transverse end members 4 and stiffened with cross braces 5.

Flanges 6 of longitudinal members 3 have holes through which the stud for the stud and bolt assembly 12 can pass. The detail of the stud and bolt assembly 12 is illustrated in FIG. 4.

Flange 8 of transverse end member 4 can also have holes (not shown) to accomodate means for joining the stone to the frame. Flanges 30 of cross braces 5 can also have holes (not shown) to accomodate means for joining the stone to the frame if required. Cross braces 5 should only be used to join the frame to the stone if the flanges 30 of the cross braces are in substantial planar alignment with the flanges 8 of member 4 and flanges 6 of member 3. Shims can be used under flanges 30 of member 5 to fill any spaces which may exist between cross braces 5 and flat rigid member 11.

FIG. 1 illustrates that the frame is narrower and shorter than the facing of the panel. The difference in size is not critical but depends upon the requirements for mounting the panel and the requirements of the stone facing for support.

The longitudinal members 3, transverse end members 4 and cross braces 5 are fabricated from metal. They can be made of steel, galvanized steel, stainless steel and other metals which have suitable physical characteristics which are known to one skilled in the art. It is preferred to fabricate the members 3, 4 and 5 from steel or galvanized steel. The longitudinal members 3, transverse end members 4 and optionally the cross braces 5 are fabricated with a cross section resembling a Z. The cross sectional form of the members is advantageous because it permits the flat rigid members and the stone facing to be drilled through holes in the flanges of members 3, 4 and 5 without interference from another portion of the member to provide holes in the rigid member and the stone in substantial alignment with the holes in the flanges.

The dimension of the webs and flanges of longitudinal members 3, transverse end members 4 and cross braces 5 is dependent on factors such as the height and width of the panel, the weight of the stone, the spacing of the members, calculated wind loading and the like.

In the preferred embodiment shown in the figures, the longitudinal members, transverse end members and cross braces are formed with a cross section in the shape of a Z as shown in FIGS. 1, 2, 3 and 4. The depth and thickness of the web and the thickness of the flanges of the longitudinal members 3 are determined. The depth of the cross braces 5 is then equal to the depth of member 3 minus the thickness of flange 18. The depth of the transverse end piece is equal to the depth of member 3 plus the thickness of flange 8. When the foregoing relationship between the members in maintained the members "nest" when assembled on a flat surface and provide mutual support to each other to maintain them in an upright position with all surfaces at joints easily accessible for joining. It is preferred to join the members by welding. Other joining means such as angle clips joined to the members by nuts and bolts or rivets and the like are also suitable for joining the frame members. The longitudinal member, transverse end members and cross braces can all be of the same size if cutting and notching of the member is no handicap to efficient fabrication of the frame. If the cross braces are not to be joined to the stone facing, they can optionally be fabricated with a cross section different from the longitudinal and transverse end members.

In assembling panel 2, the stones 13 in FIGS. 2 and 3 are laid in the desired arrangement on a flat surface and the joints are adjusted by means of spacers of the required thickness. The flat rigid member 11 can be joined to the frame by means of self-tapping screws through the flanges, nuts and bolts, suitable adhesives or by welding if the flat rigid member is made of metal. The substantially flat rigid member adds rigidity to the frame and provides a flat surface in contact with the stones.

The frame 31 and the flat rigid member 11 are laid on the stones and holes are drilled through the flat rigid member and only a part of the way through the stones. Blind holes are formed in the stones. The holes are drilled through the holes in the flanges of the frame 31 so that the holes in the stones 13, flat rigid member 11 and flanges of the frame are in substantial alignment.

As shown in FIG. 4 a liquid material to anchor studs 14 in holes 16 is poured into holes 16. Stainless steel studs 14 are placed in holes 16 and the anchoring material is permitted to set. Washers 19 are placed over studs 14 and nuts 15 are tightened over studs 14 to join stones 13 to frame 13 to form panel 2.

Materials for anchoring joining members in holes are well known in the art. A hardenable epoxy resin formulation is preferred but certain non-shrinking cement formulations, lag bolt type fasteners and the like can also be suitable.

The stud and nut joining arrangment shown in FIG. 4 is a preferred embodiment but other joining means such as hollow rivets, lag bolts and the like can suitably join the stones to the frame.

The flat rigid member can either be in sections or a single piece and is fabricated from plywood, metal, cement asbestos board, glass reinforced plastics and the like. However, due to its hardeness, rigidity and low cost, cement asbestos board is the preferred material. The thickness of the substantially flat rigid member can range from about 0.05 to about 1.0 inches in thickness depending on the material from which it is made but is usually in the range of from about 0.20 to 0.5 inches thick.

FIG. 2 is a section through panel 2 showing several stones 13 having joints 9 in contact with substantially flat rigid member 11. The Z shape cross section of cross braces 5 and transverse end member 4 can be clearly seen. The substantially planar alignment of the flanges of the longitudinal members and the transverse end members adjacent to substantially flat rigid member 11 is shown in FIGS. 2 and 3.

The relationship in the depths of the longitudinal members 3, transverse end members 4 and cross braces 5 in the preferred embodiment can be seen in FIGS. 2 and 3. Flange 7 of transverse end member 4 rests on flange 18 of longitudinal member 3 to provide support to the frame before the members are joined together. The relationship between flanges 32 of cross braces 5 and flanges 6 and 18 of longitudinal members 3 can also be seen in FIGS. 2 and 3.

The joints between the stones can contain a filler seen as mortar, caulking compounds and the like.

FIG. 4 which has been referred to above is a cross section through the panel to show the cross sectional shape of the longitudinal member 3 and an embodiment of the means of joining the facing to the frame.

Longitudinal member 3 comprises web 20 and two substantially parallel flanges 6 and 18 which extend to opposite directions from the ends of the web.

In assembling the panel a hole is drilled through rigid member 11 and only partly through stone 13 to form blind hole 16. Blind holes 16 in the stone, hole 34 in rigid member 11 and hole 35 in flange 6 are in substantial alignment since holes 16 and 34 were drilled through hole 35. Threaded stainless steel stud 14 was placed in hole 16 after a liquid stud anchoring material was introduced into hole 16. The anchoring material fills void space 17, hardens and retains the stud in hole 16. When the anchoring material has set, washer 19 is placed over stud 14 and nut 15 is tightened over stud 14 to join the stone to the frame and form a panel structure. Other joining means which can be anchored in the stone also can be suitable in the practice of the invention.

The panel facing can be almost any solid material which is suitable for a facing but natural stone such as marble, granite, travertine, fieldstone, and the like are preferred. The stone is usually provided in relatively thin slabs having at least one and preferably two substantially flat surfaces. However, if it is required, flat stones with irregular surfaces can be joined to the frame by aligning the stones on a bed of loose material such as sand and placing a mortar or cement mixture over the back of the stones to provide a flat surface to bear against the substantially flat rigid member.

Figure 5:
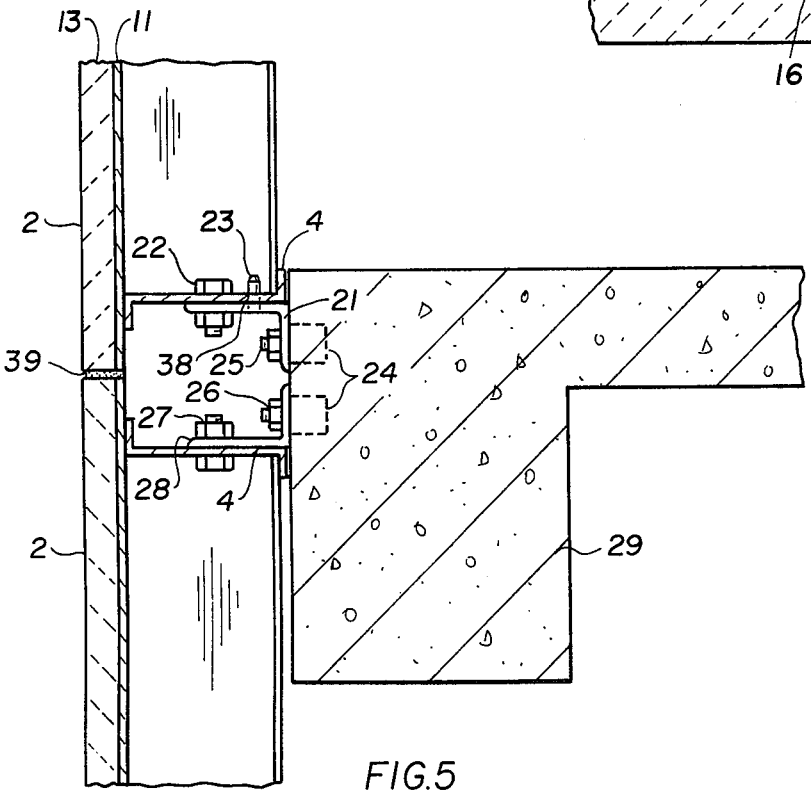
FIG. 5 is an embodiment of a method for securing the prefabricated panel to a building structure.

FIG. 5 is an embodiment of a method for attaching the prefabricated panels to a building structure. A section of top and bottom portions of prefabricated panels 2 are shown attached to concrete spandrel 29 which is part of building structure (building not shown).

The bottom of panel 2 is supported by shelf bracket support 21 which is affixed to concrete spandrel 29 by means of concrete insert 24 and stud and bolt assembly 25. Landing stud 23 is affixed to shelf bracket support 21 to engage oversize holes 38 in transverse end member 4 of panel 2 so that the panel can be readily guided into place. The position of panel 2 in relation to vertical and horizontal alignment with the building and adjacent panels can be adjusted by means of slotted holes (not shown) which engage one or more nut and bolt assemblies 22 which lock the panels in position on shelf bracket support 21. Usually two or more nut and bolt assemblies 22 are required to secure the bottom of panel 2 in proper alignment. Shims may be inserted between transverse end member 4 and shelf bracket support 21 to provide proper spacing between panels and to provide proper panel alignment. Filler material 39 can be utilized to seal the spacing between the stones on the panel 2 facing. Flexible fillers such as room temperature vulcanizing silicone rubber compositions, butyl rubber based compositions, acrylic based compositions, polysulfide based caulking compositions and the like are useful for sealing the spaces between adjacent panels.

The top of panel 2 is secured to the building structure by means of clip angles 38 affixed to concrete spandrel 29 by means of concrete insert 24 and stud and bolt assembly 26. Bolt and nut assembly 27 engages slotted holes (not shown) in the transverse end member 4, at the top of panel 2. The slotted holes permit alignment of the panel with the building and with adjacent panels. Shims may be inserted if required between clip angles 28 and transverse end member 4 of panel 2 to provide a secure connection between the panel and clip angles. Usually two or more clip angles are used to secure the top of the panel to the building structure.

Panels attached to a concrete spandrel is shown but a similar arrangement is suitable for attaching the panels to structures having a metal framework.

As can be noted the open back of the panels permit easy access to the means for securing the panels to the shelf bracket supports and the clip angles.

Insulation can be inserted between the longitudinal members and a suitable wall forming member such as plaster board can be attached to the flanges 18 of the longitudinal members, flanges 32 of the cross braces and flanges 7 of transverse end member 4 to provide a pleasing interior facing to the prefabricated building panel.

As one skilled in the art will recognize the use of members with a Z shaped cross section to form the frame for a prefabricated panel provides many advantages for easy assembly of a lightweight rigid frame. Joining the stone to the frame by joining means which extend from the back of the stone facing can provide a strong structure without esthetically unpleasant intrusions onto the front of the stone facing.

I claim:

1. A prefabricated Panel which comprises:

a. A frame for supporting facing in a prefabricated panel which comprises; substantially parallel longitudinal members, fixed at the ends by transverse end members attached to said longitudinal members and stiffened with cross braces attached to said longitudinal members, at least said longitudinal members, and transverse end members comprising metal members having a web with two substantially parallel flanges extending in opposite directions from said web and said flanges on at least one side of said longitudinal and transverse end members being in substantial planar alignment and at least said flanges on said longitudinal members in planar alignment with said flanges on said transverse end members having holes through which means for joining said supported facing to said frame can pass.

b. one or more substantially flat rigid members which at least cover the frame and are adjacent to the flanges of the longitudinal and transverse end members which are in substantial planar alignment, said flat rigid members having holes in alignment with the holes in the flanges of the frame adjacent thereto, c. a stone facing member having an exposed front and a back, the back of said facing member being adjacent to said rigid member and having means extending from blind holes in the back of said facing member which pass through said holes in said rigid member and said frame to join said facing, said rigid member and said frame into a prefabricated panel.

2. The prefabricated panel of claim 1 wherein said rigid member is asbestos cement board.

3. The prefabricated panel of claim 2 wherein said facing is selected from a group consisting of marble, granite, travattine, and fieldstone and wherein said means extending from the back of said facing are threaded studs anchored in blind holes in the back of said facing with an epoxy resin and said facing is joined to said frame by means of nuts which interact with the threads on said studs.

* * * * *

UNITED STATES PATENT OFFICE
CERTIFICATE OF CORRECTION

Patent No. 4,045,933 Dated September 6, 1977

Inventor(s) Joseph R. Grillo

It is certified that error appears in the above-identified patent and that said Letters Patent are hereby corrected as shown below:

Column 1, line 30: "multi-store" should be --multi-story--.

line 54: "Channel studs" should be -- "Channel studs" --.

Column 2, line 60: "completely" should be --completed--.

Column 4, line 44: "frame 13" should be --frame 31--.

Column 5, line 13: "seen" should be --such--.

line 18: "of" (2nd occurrence) should be --for--.

line 20: "to" should be --in--.

line 24: "holes" should be --hole--.

UNITED STATES PATENT OFFICE
CERTIFICATE OF CORRECTION

Patent No. 4,045,933 Dated September 6, 1977

Inventor(s) Joseph R. Grillo

It is certified that error appears in the above-identified patent and that said Letters Patent are hereby corrected as shown below:

Column 5, last line: "Filler material 39 can be uti-" should be set off as the beginning of a new paragraph.

Column 6, line 8: "angles 38" should be --angles 28--.

Column 7, line 6: "a" should be --the--.

line 7: "travattine" should be --travertine--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*